US005935880A

United States Patent [19]

Wang et al.

[11] Patent Number: 5,935,880

[45] Date of Patent: Aug. 10, 1999

[54] DISPERSIBLE NONWOVEN FABRIC AND METHOD OF MAKING SAME

[76] Inventors: Kenneth Y. Wang, 292 Cutty Sark Way, Alpharetta, Ga. 30202; Leroy M. Demeny, 2241 Moonlight Dr., Green Bay, Wis. 54313; William S. Pomplun, 1873 Brookfield Dr., Neenah, Wis. 54956; Pavneet S. Mumick, 1514 Schaefer Cir., Apartment #5, Appleton, Wis. 54915; Ralph L. Anderson, 5074 Wood Haven Ct., Marietta, Ga. 30062; Joseph F. Merker, 5010 Matthew Meadow Ct., Alpharetta, Ga. 30201

[21] Appl. No.: 08/829,085

[22] Filed: Mar. 31, 1997

[51] Int. Cl.[6] ..... D04H 1/46; D04H 1/58

[52] U.S. Cl. ..... 442/65; 28/104; 162/112; 442/154; 442/408

[58] Field of Search ..... 162/112; 28/104; 442/408, 118, 76, 65, 154

[56] References Cited

U.S. PATENT DOCUMENTS

| | | | |
|---|---|---|---|
| 31,825 | 2/1861 | Mason et al. | 428/198 |
| 3,616,797 | 11/1971 | Champaigne, Jr. et al. | 128/290 |
| 3,654,928 | 4/1972 | Duchane | 128/290 |
| 3,913,579 | 10/1975 | Srinivasan et al. | 128/290 |
| 4,207,367 | 6/1980 | Baker, Jr. | 428/171 |
| 4,309,469 | 1/1982 | Varona | 428/74 |
| 4,749,423 | 6/1988 | Vaalburg et al. | 156/181 |
| 4,755,421 | 7/1988 | Manning et al. | 428/224 |
| 4,894,118 | 1/1990 | Edwards et al. | 162/112 |
| 5,137,600 | 8/1992 | Barnes et al. | 162/115 |
| 5,292,581 | 3/1994 | Viazmensky et al. | 428/288 |
| 5,508,101 | 4/1996 | Patnode et al. | 428/286 |

FOREIGN PATENT DOCUMENTS

| | | |
|---|---|---|
| 0807704 | 11/1997 | European Pat. Off. . |
| 9612615 | 5/1996 | WIPO . |

OTHER PUBLICATIONS

May 2, 1996, by Anderson et al. entitled, "A Thermal Bonded, Solvent Resistant Double Re–Creped Towel".

Pomplun et al., entitled "Ion sensitive Polymeric Materials," filed Mar. 7, 1997.

*Primary Examiner*—Blaine Copenheaver

*Attorney, Agent, or Firm*—Bernstein & Associates P.C.

[57] ABSTRACT

A soft, absorbent nonwoven fibrous web, such as a wet wipe, capable of dispersing in an aqueous environment into unrecognizable pieces, made by a method comprising the steps of forming a wet-laid nonwoven web from an aqueous slurry of fibers; hydraulically needling the wet-laid nonwoven web; partially drying the hydraulically needled web; applying a binder composition to one side of the web; creping the web such that interfiber adhesion is disrupted and z-direction fiber orientation is introduced; optionally applying a binder composition to the second side of the web; recreping the web; drying and curing the web; and, converting the dried and cured web into a wet wipe, dry wipe, or other absorbent article. In the case of a wet wipe, a solution containing about 100 ppm of calcium ion is applied to the web, such as in a preserving solution. In the case of a dry wipe, the calcium ion is added after the binder is added to the web, and the final product is stored in a dry state. The combination of processes produces a web having desirable tensile strength, bulk and softness during storage and use, yet will disperse in an aqueous environment into unrecognizable pieces.

43 Claims, 2 Drawing Sheets

| PROCESS STEP | SAMPLE NUMBER 1 | 2 | 3 | 4 | 5 | 6 |
|---|---|---|---|---|---|---|
| WET-LAY WEB FORMATION | x | x | x | x | x | x |
| HYDROPOINT/DRY | x | x | x | x | x | x |
| PRINT BINDER (2x) | | x | | x | | x |
| CREPE (2x) | | x | | x | | x |
| ADD Ca++ | | | x | x | x | x |
| PLACE IN TAP WATER (5 MIN.) | | | | | x | x |

DISPERSIBLE NONWOVEN FABRIC AND METHOD OF MAKING SAME

FIELD OF THE INVENTION

The present invention relates to water-dispersible fibrous nonwoven composite structures formed from a wet-laid web. More particularly, the present invention relates to a wet wipe article formed by a process comprising forming a wet-laid web from an aqueous suspension of pulp, hydraulically needling the web, adding a binder to one side of the web, creping the needled web, adding a binder to the second side, recreping the web, followed by drying and/or curing the web. After formation of the final product the wipe is stored in a solution containing a divalent ion to provide dispersibility characteristics.

BACKGROUND OF THE INVENTION

Webs formed from absorbent nonwoven pulp fibers have long been used as practical and convenient disposable hand towels or wipes. These nonwoven webs are typically manufactured by conventional high speed papermaking processes having additional post-treatment steps designed to increase the absorbency or other characteristics of the web. Exemplary post-treatment steps include creping, aperturing, embossing, hydraulic needling, hydroentanglement, binder addition, and the like. Most web-forming processes use either a wet-laid process or an air-laid process. A wet-laid process deposits a slurry of fibers in water onto a moving foraminous support surface, typically a wire mesh, screen or fabric, using water flow to lay down the fibers. The fibers are thus oriented predominantly in the x,y-directions. Webs created by a wet-laid process are ordinarily less expensive to produce than by an air-laid process, but the wet-laid web has poorer z-direction fiber orientation. Thus, paper, such as typing paper, has good x,y-direction tensile strength characteristics, but poor softness, bulk, absorptivity and z-direction thickness. For absorbent products, such as wipes, softness, thickness, strength and absorbency during use are key desired qualities.

Many of the items or products into which wet-laid web materials are incorporated are generally regarded as being limited-use disposable products. By this it is meant that the product or products are used only a limited number of times and in some cases only once before being discarded. With increasing concerns over solid waste disposal, there is now an increasing need for materials that are, for example, either recyclable or disposable through other mechanisms besides incorporation into landfills. One possible alternative means of disposal for many products, especially in the area of personal care absorbent products and wipers, is by flushing them into sewage disposal systems. As will be discussed in greater detail below, flushable means that the material must not only be able to pass through a commode without clogging it, but that the material must also be able to pass through the sewer laterals between a house (or other structure housing the commode) and the main sewer system without getting caught in the piping, and to disperse into small pieces that will not clog a toilet or the sewer transport and treatment process.

In recent years, more sophisticated approaches have been devised to impart dispersibility. Chemical binders that are either emulsion or melt processable or aqueous dispersions have been developed. Such chemical binders are typically sprayed or printed onto the web and absorbed or partially absorbed by the fibers. The material can have high strength in its original storage environment, but quickly lose strength by debonding or dispersing when placed in a different chemical environment (e.g., pH or ion concentration), such as by flushing down a commode with fresh water. It would be desirable to have a bonding system that would produce a fabric having desirable strength characteristics, yet be able to rapidly disperse or degrade after use into small pieces.

U.S. Pat. No. 4,309,469 and 4,419,403, both issued to Varona, describe a dispersible binder of several parts. Reissue Patent No. 31,825 describes a twostage heating process (preheat by infrared) to calendar bond a nonwoven consisting of thermoplastic fibers. Although offering some flexibility, this is still a single thermal bonding system. U.S. Pat. No. 4,207,367 issued to Baker, describes a nonwoven which is densified at individual areas by cold embossing. The chemical binders are sprayed on and the binders preferentially migrate to the densified areas by capillary action. The non-densified areas have higher loft and remain highly absorbent. However, it is not a hybrid bonding system because the densification step is not strictly a bonding process. U.S. Pat. No. 4,749,423, issued to Vaalburg et al., describes a two stage thermal bonding system. In the first stage, up to 7% of the polyethylene fibers in a web are fused to provide temporary strength to support transfer to the next processing stage. In the second stage the primary fibers are thermally bonded to give the web its overall integrity. This process in two distinct stages does not permit the web to have a structure of built-in areas of strength and weakness. It is not suitable as a dispersible material.

Several patents describe hybrid bonding systems, but are for sanitary napkin covers. For example, see U.S. Pat. No. 3,654,924, to Duchane, U.S. Pat. No. 3,616,797, issued to Champagne et al., and U.S. Pat. No. 3,913,574, issued to Srinvasan et al. The important difference is that these products are designed to be stored dry and to have very limited wet strength for a short duration during use. In a wet wipe there remains a need for prolonged wet strength in a storage solution.

U.S. Pat. No. 5,137,600, issued to Barnes et al. and commonly assigned to the assignee of the present invention, describes a hydropoint process for improving z-direction orientation and thickness. U.S. Pat. No. 4,755,421, issued to Manning et al. describes a process for forming a hydroentangled disintegratable fabric. U.S. Pat. No. 5,508,101, issued to Patnode et al., discloses a web composed of a hydrolytically degradable polymer and a water soluble polymer, such that the material, when submersed in water at an elevated temperature and elevated pH, will disintegrate. This web material appears to be primarily used in a laundry cycle where such extreme conditions occur. It would be desirable to have a fabric article that is dispersible at room temperature and nominal pH conditions, such as those that exist in the common household toilet bowl. U.S. Pat. No. 5,292,581, issued to Viazmensky et al., discloses a wet wipe that has strength characteristics, but is not immediately dispersible in water.

SUMMARY OF THE INVENTION

The present invention remedies the deficiencies in the prior art and provides a soft, absorbent nonwoven fibrous web, such as a wet wipe, capable of dispersing in an aqueous environment into unrecognizable pieces, made by a method comprising the steps of forming a wet-laid nonwoven web from an aqueous slurry of fibers; hydraulically needling the wet-laid nonwoven web; partially drying the hydraulically needled web; applying a binder composition to one side of the web; creping the web such that interfiber adhesion is disrupted and z-direction fiber orientation is introduced; optionally applying a binder composition to the second side of the web; recreping the web; drying and curing the web; and, converting the dried and cured web into a wet wipe, dry wipe, or other absorbent article. In the case of a wet wipe, a solution containing a divalent ion, such as calcium and/or magnesium, in a concentration of about 100 ppm is applied to the web, such as in a preserving solution. In the case of a dry wipe, the ion is added after the binder is added to the web, and the final product is stored in a dry state. The combination of processes produces a web having desirable tensile strength, bulk and softness during storage and use, yet will disperse in an aqueous environment into unrecognizable pieces.

Accordingly, it is a principal object of the present invention to provide a water-dispersible nonwoven fabric that maintains sufficient tensile strength while in a preserving solution yet also possesses desirable softness, bulk and strength characteristics during use.

It is another object of the present invention to provide a nonwoven fabric wet wipe that will disperse in water to form unrecognizable pieces.

Other objects, features, and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
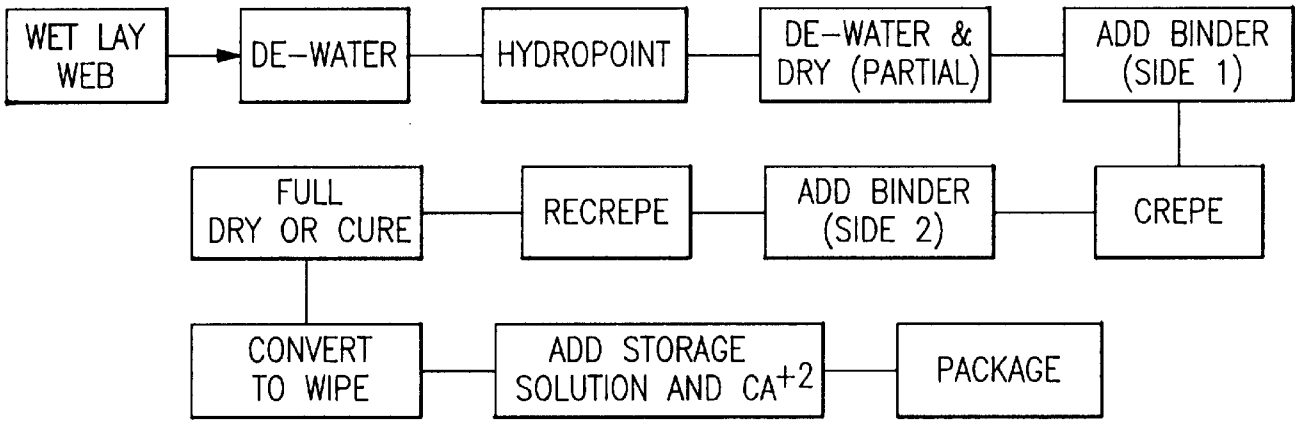
FIG. 1 is a block diagram of a process according to a first preferred embodiment of the present invention for forming a web suitable for use as a wet wipe.

The present invention is directed to a water-dispersible nonwoven fibrous structure comprising mainly pulp. The web structure can be incorporated into either a wet wipe or a dry wipe. A wet wipe is an article that is typically stored in a storage or preserving solution to maintain a certain water (or other liquid) content in the web so that it is wet during use. An example of a wet wipe is an adult or baby wipe. A dry wipe is an article that is stored in a dry form and may be used either dry or may be wetted during use. Examples of dry wipes are paper towels, tissues, and toilet paper.

The present invention provides for two distinct, but similar, processes to form a wet wipe and a dry wipe, respectively. In general, the basic web structure is formed by a series of steps comprising, in brief, forming a web from an aqueous suspension of pulp fibers by a wet-laid process, hydraulically needling the wetlaid nonwoven web on a support wire, partially drying the hydraulically needled web, creping the web such that interfiber adhesion is disrupted, adding a binder composition onto the obverse side of the web, recreping the binder-printed web, drying and/or curing the web, and transferring the dried web to take up roll or converting to product. For a wet wipe the final product is stored in a preserving solution containing approximately 100 ppm of a divalent ion. For a dry wipe the divalent ion is added to each side of the web after the binder is added and no preserving solution is needed.

A first preferred embodiment of the present invention is a process to form a wet wipe, described as follows. A second preferred embodiment, for forming a dry wipe, is described thereafter.

The initial web is made from a material such as, but not limited to, wood pulp or other cellulose-based composition. Pulp fibers are generally obtained from natural sources such as woody and non-woody plants. Woody plants include, for example, deciduous and coniferous trees. Non-woody plants include, for example, cotton, flax, esparto grass, milkweed, straw, jute, and bagasse. Wood pulp of any suitable fiber length can be used. Wood pulp fibers typically have lengths of about 0.5 to 10 millimeters and a length-to-maximum width ratio of about 10:1 to about 400:1. A typical cross-section has an irregular width of about 30 micrometers and a thickness of about 5 micrometers. One wood pulp suitable for use with the present invention is southern softwood kraft, or Kimberly-Clark CR-54 wood pulp from the Kimberly-Clark Corporation of Neenah, Wis. Other material commonly used in the art can also be utilized. A mixture of different pulp compositions and/or fiber lengths can be used.

It is preferable, although not required, that a synthetic fiber material in a concentration range of from about 0% to about 30%, more preferably up to about 5%, be mixed with the pulp. The upper limit of the percentage of synthetic fiber material is not critical to the present invention. The synthetic material can be rayon, lyocell, polyester, polypropylene, and the like. Rayon and Lyocell are preferred due to their biodegradability. The synthetic fibers should be shorter than about 12 mm, preferably about 6–8 mm. Longer fiber lengths tend to cause roping problems when flushed down a toilet. The synthetic fibers can be crimped to provide additional bulk to the final product.

The present invention also contemplates treating the nonwoven pulp fiber web with additives such as, but not limited to, binders, surfactants, hydrating agents and/or pigments to impart desirable properties such as abrasion resistance, toughness, color or improved wetting ability. Alternatively and/or additionally, the present invention contemplates adding particulates such as, but not limited to, activated charcoal, clays, starches, fluff, and the like to the absorbent nonwoven web. Such superabsorbent additives are typically used where a dry wipe is the end product being fabricated.

The fibrous material is formed into a web by wet-laid process, which is known to those skilled in the art. An example of the wet-laid process is disclosed in PCT application Ser. No. WO 96/12615, published May 2, 1996, by Anderson et al., entitled "A Thermal Bonded, Solvent Resistant Double Re-creped Towel." Briefly, a wet laid web is formed by mixing the fibrous material or materials with water or other liquid or liquids to form an aqueous suspension or slurry. This suspension is deposited onto a moving foraminous forming surface, such as wire or fabric mesh. For the purposes of the present description the foraminous surface will be referred to as a support wire. The support wire may be, for example, a single plane mesh having a mesh size of from about 40×40 to about 100×100. The support wire may also be a multi-ply mesh having a mesh size from about 50×50 to about 200×200. In one embodiment of the present invention the support wire may have a series of ridges and channels and protruding knuckles which impart certain characteristics to the nonwoven web. A vacuum box and associated vacuum pump source are disposed beneath the support wire and dewater the web. The web, however, is typically not completely dry at this point. It is preferable that a wet-laid web be vacuum dewatered down to about 500% water content by dry weight of web. The wet-laid process results in a web structure in which the fibers are oriented primarily in the x,y-directions, i.e., parallel to the plane of the foraminous structure. This orientation provides for tensile strength in the x,y -directions, but for little softness and bulk because there is little fiber orientation in the z-direction.

It is to be understood that while wet-laid web formation is a preferred method of forming the web because, in part, it is a less expensive process, an air-laid process, as is known to those of ordinary skill in the art can be used to form a web usable in further processing according to the present invention.

In order to improve z-direction orientation the dewatered web is subjected to hydraulic needling, also referred to as a hydropoint process. An example of the hydropoint process is disclosed in U.S. Pat. No. 5,137,600, issued to Barnes et al. The hydropoint process involves the use of low pressure jetting, as distinguished from hydroentanglement, which involves the use of high pressure jetting. The nonwoven web may be, and preferably is, wet-laid formed and hydraulically needled on the same support wire, particularly where the entire process of the present invention is adapted for use in a high speed, high output commercial process. The support wire may be smoother patterned to impart aesthetic patterns and/or textures to the web. Alternatively, the web may be transferred after wet-laid forming to a different support wire for hydraulic needling. Hydraulic needling can be done on a web that is wet, dried, or partially dried. The hydraulic needling may take place while the nonwoven web is at a consistency of from about 15 to about 45 percent solids. More preferably, the nonwoven web may be at a consistency of from about 25 to about 30 percent solids.

Low pressure jets of a liquid (e.g., water or similar working fluid) are used to produce a desired loosening of the pulp fiber network. It has been found that the nonwoven web of pulp fibers has desired levels of absorbency when jets of water are used to impart a total energy of less than about 0.03 horsepower-hours/pound of web. For example, the energy imparted by the working fluid may be between about 0.002 to about 0.03 horsepower-hours/pound of web. More preferably, the energy range is from about 0.01 to about 0.1 horsepower-hours/pound of web. It is to be understood that the energy range is not critical to the process.

The nonwoven web passes under one or more hydraulic needling manifolds and is treated with jets of fluid to open up or loosen and rearrange the tight x,y-directional network of pulp fibers. It is believed that the water jets contact the fibers laying in the x,y-direction of the nonwoven web and rearrange a portion of these fibers into the z-direction. This increase in z-direction oriented fibers increases the web integrity. Principal benefits of this treatment is the improvement of wet bulk, resiliency and softness. It is to be understood that the hydraulic needling process of the present invention can be done either from above or below the web, or in both directions.

Vacuum slots and associated vacuum force are located beneath the support wire downstream of the entangling manifold so that excess water is withdrawn from the treated web. After hydraulic jet treatment, the web may then be transferred to a non-compressive drying operation to remove all or a portion of the water therein, such that interfiber adhesion is enhanced within the web. A differential speed pickup roll may be used to transfer the web from the hydraulic needling belt to a non-compressive drying operation, such as, but not limited to through-air drying, infra-red radiation, yankee dryers, steam cans, microwaves, and ultrasonic energy, and the like. Such drying operations are known to those of ordinary skill in the art. The web can be dried completely, or to a desired consistency. Preferably, the web is dried to a water presence of about 5–10%. Thus, the web is usually not completely dry at this stage, but, if the web were to be wound onto a takeup roll and stored prior to further post-formation treatment, it could be dried completely.

The basis weight of the web is in the range of from about 25 gsm to about 200 gsm, more preferably of from about 50 gsm to about 100 gsm, and most preferably of from about 65 gsm to about 75 gsm.

A binder composition is added to the web according to known processes, such as, but not limited to printing or spraying, in order to increase web tensile strength. In the present invention, the binder is preferably a water soluble polymeric composition having from about 25 weight % to about 90 weight % of an unsaturated carboxylic acid/unsaturated carboxylic acid ester terpolymer; from about 10 weight % to about 75 weight % of a divalent ion inhibitor; and, can have from about 0 weight % to about 10 weight % of a plasticizer. The binder can be an add on of from about 1 weight % to about 40 weight percent, preferably from about 5 weight % to about 25 weight %, and more preferably from about 5 weight % to about 15 weight %.

As used herein, the term "divalent ion inhibitor" means any substance which inhibits the irreversible cross-linking of the acrylic acid units in the base terpolymer by the divalent ions. The divalent ion inhibitor can be a composition including, but not limited to sulfonated copolyester, polyphosphate, phosphonic acid, aminocarboxylic acid, hydroxycarboxylic acid, polyamine, and the like. More particularly, the divalent inhibitor can be selected from Eastman AQ29D, AQ38D, AQ55D, AtoFindley L9158, sodium tripolyphosphate, nitrilotriacetic acid, citric acid ethylene diametetra(methylenephosphonic acid), ethylenediaminetetraacetic acid, porphozine, and the like.

Exemplary plasticizers include, but are not limited to, glycerol, sorbitol, emulsified mineral oil, dipropyleneglycoldibenzoate, polyglycols such as, polyethylene glycol, polypropylene glycol and copolymers thereof, decanoyl-N-methylglucamide, tributyl citrate, tributoxyethyl phosphate and the like.

Perfumes, colorants, antifoams, bactericides, bacteriostats, surface active agents, thickening agents, fillers, as well as other water-soluble binders, such as, but not limited to, polyvinyl alcohol, aqueous dispersions of, for example, polyvinyl chloride, polyacrylates, polymethacrylates, copolymers of acrylates and methacrylates, polymers of acrylic acid, methacrylic acid or a salt thereof, carboxymethylcellulose and the like, may also be incorporated into the binder, if desired.

A typical method for adding the binder to the web is to place an aqueous mixture of the binder into a bath. A take up dip roll is placed in the bath so that a portion of the roll's exterior surface is in contact with the mixture. As the dip roll rotates, it takes up an amount of the binder, the excess of which is removed by an angled doctor blade positioned adjacent to the dip roll. The dip roll is in a nipped relationship with a pattern roll so that the binder on the dip roll is transferred to the patterned surface on the pattern roll. Preferably, the binder solution is taken up only on the pattern pins or protrusions of the pattern roll and not the entire surface of the pattern roll. The pattern roll is part of a nip roll assembly with a smooth, or anvil, roll. As the web is passed through the nip roll assembly the pattern roll imprints a pattern onto the web and the binder is transferred onto one side of the web.

An alternative method of applying the binder is to spray it onto one or both sides of the web.

The web is creped according to known creping processes, such as that described in U.S. Pat. No. 4,894,118, issued to Edwards et al. and commonly assigned to the assignee of the present invention, or as described in PCT application number WO 96/12615, filed by Anderson et al. Briefly described, the web is creped from a dryer drum by a doctor knife. The doctor knife disrupts interfiber adhesion. Creping breaks the stiffness of the web and adds a degree of flexibility and z-direction resilience.

After the initial creping, the binder composition as described above (or a different binder composition, where different faces of the web are to have different characteristics) is added to the obverse side of the web, such as by conveying the web to a second niproll and bath assembly, or conveying the creped web back through the first niproll and bath assembly.

The web is then recreped according to the creping process discussed above. After the recreping the web is dried completely or cured. The finished web can be immediately converted into usable products or stored on a take up roll.

Where a wet wipe is the final product a preserving solution, usually aqueous, is added. The preserving solution contains a multivalent ion, preferably a divalent ion, such as, but not limited to calcium, magnesium and the like. Other, more complex, ions are also contemplated as being within the scope of the present invention. The ions impart a reversible cross-linking to the binder. In a preferred embodiment, calcium ion is used, having a concentration in the range of from about 25 ppm to about 300 ppm, more preferably from about 50 ppm to about 200 ppm, and still more preferably about 100 ppm. A preferred binder composition is described in greater detail in copending application Ser. No. 08/819,246 by Pomplun et al., entitled "Ion Sensitive Polymeric Materialis," filed Mar. 17, 1997, pending and commonly assigned to the assignee of the present invention. When the product is used and disposed of in the toilet, the dilution of the calcium ions in water triggers the reversible chemical change, resulting in the web breaking up into small, unrecognizable pieces, which are easily carried into the sewage system.

The final coherent fibrous fabric exhibits improved tensile strength when compared to the tensile strength of a similar but untreated wet-laid or dry-laid fabric. However, and quite advantageously, the fabric will disintegrate or is disintegratable when placed in soft to moderately hard cold water and agitated.

As used herein "moderately hard" water means water which possesses a total concentration of from about 25 ppm to about 50 ppm of divalent ions. Non-limiting examples of divalent ions include calcium and/or magnesium ions. It is to be understood that soft water has a concentration of divalent ions of less than about 25 ppm and very hard water has a concentration of divalent ions of more than about 50 ppm. As used herein "disintegrate," "disintegratable" and "water dispersible" are used interchangeably to describe the breaking up or separating into multiple parts where after about 60 minutes, preferably, after about 20 minutes, and more preferably within about 5 minutes, in an aqueous environment (having a concentration of divalent ions of less than about 50 ppm), the fabric separates into multiple pieces each having an average size of smaller than about 3 inches effective diameter, more preferably smaller than about 2 inches effective diameter, and even more preferably smaller than about 1 inch effective diameter. Materials having a tensile strength of less than about 50 g/inch are commonly considered to be dispersible.

The finished wipes may be individually packaged, preferably in a folded condition, in a moisture proof envelope or packaged in containers holding any desired number of prefolded sheets and stacked in a water-tight package with a wetting agent (e.g., an aqueous solution containing calcium ions) applied to the wipe. The wetting agent may comprise, by weight, from about 10% to about 400% of the dry weight of the wipe itself. The wipe should maintain its desired characteristics over the time period involved in warehousing, transportation, retail display and storage by the consumer. Accordingly, shelf life may range from two months to two years, or more.

Various forms of impermeable envelopes designed to contain wet-packaged materials such as wipes and towelettes and the like are well known in the art. Any of these may be employed in packaging the premoistened wipes of the present invention.

Figure 2:
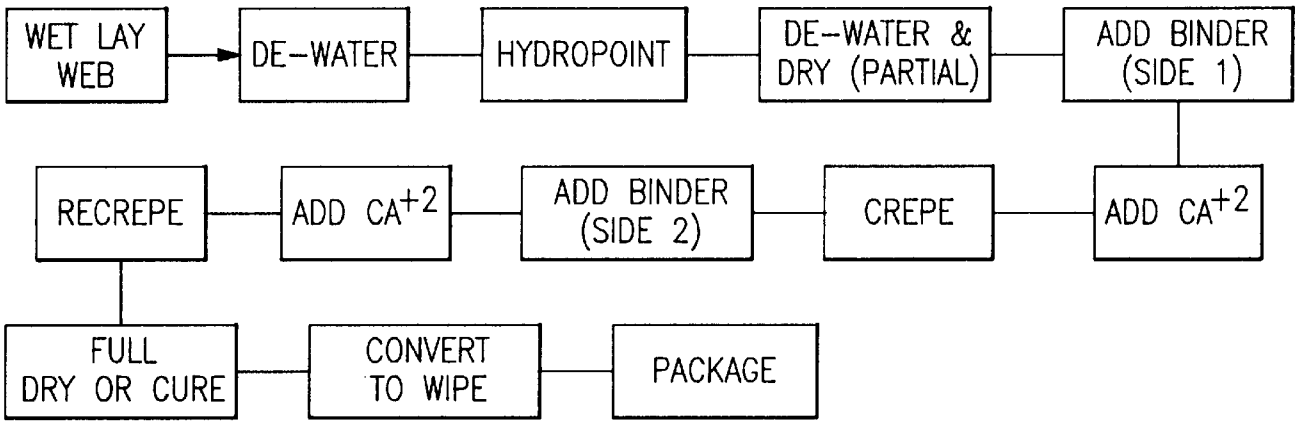
FIG. 2 is a block diagram of a process according to a second preferred embodiment of the present invention for forming a web suitable for use as a dry wipe.

In a second preferred embodiment of the present invention a dry wipe can be formed, as shown in FIG. 2. In this embodiment the same general sequence of steps and materials are used, with the following differences. After the binder is added to the first side of the wipe a solution containing the multivalent or divalent ion is added, preferably by spraying the solution onto the web. It is preferable not to premix the binder and ion together because coagulation can occur, clogging a spray nozzle or pattern roll. Therefore, the divalent ion, such as calcium ion in the concentration ranges described hereinabove, is preferably sprayed onto the web after the binder is applied. Should coagulation occur in the web, this would not materially affect the end product. The divalent ion is again added to the obverse side after the second binder addition step. Drying and further processing is as described above. Since the final product is a dry wipe, tissue or the like, no storage solution is used.

The nonwoven fabric of the present invention can be incorporated into such body fluid absorbing products as sanitary napkins, diapers, surgical dressings, tissues and the like. The nonwoven fabric retains its structure, softness and exhibits a toughness satisfactory for practical use. However, when brought into contact with water having a concentration of divalent ions of up to about 50 ppm the binder is dissolved. The nonwoven fabric structure is then easily broken and dispersed in water.

The present invention provides a product that is most easily adapted for use as a wet wipe, such as for children or adults, because of the material's clothlike thickness, wet strength in the preserving solution containing the divalent ion and during use, dispersibility in water, and low cost mass production capability. The fabric possesses the desirable characteristics provided by each of the heretofore known processes, yet maintains a balance between the properties not previously seen. For example, previous wet-laid processes produce a web but with poor z-direction orientation.

The hydropoint process used with a wet-laid web improves the z-direction orientation and thus bulk, but, alone, does not impart desirable machine direction tensile strength. The double recrepe process adds softness and integrity, while the acrylic acid terpolymer-based binder provides for tensile strength. The divalent ion imparts water dispersibility after use and disposal not previously exhibited with the double recrepe process. Normal binder used in the double recrepe process is an elastomeric latex copolymer, which is thermosetting and therefore remains durable once it is dried and cured. Products made with this type of binder are not flushable and dispersible. The triggerable binder incorporated into the present invention provides this missing dispersibility to the double recrepe process part of the overall product fabrication. Thus, it is the combination of processes heretofore described that produces a web having a desirable combination of qualities.

An additional advantage is that the process of the present invention produces high machine direction tensile strength without rigidity or stiffness commonly associated with strength. Furthermore, the hydropoint step prevents wet bulk collapse of the preserved wet wipe.

Examples of dry wipes producible according to the present invention include, but are not limited to, toilet paper, facial tissue or household towel products having desirable strength, thickness, clothlikeness and, most importantly, flushability and dispersibility.

The invention will be further described in connection with the following examples, which are set forth for purposes of illustration only. Parts and percentages appearing in such examples are by weight unless otherwise stipulated.

EXAMPLES

Test Methods

Grab Tensile test: The grab tensile test is a measure of breaking strength and elongation or strain of a fabric when subjected to unidirectional stress. This test is known in the art and conforms to the specifications of Method 5100 of the Federal Test Methods Standard No. 191A (ASTM Standards D-1117-6 or D-1682). The results are expressed in pounds to break and percent stretch before breakage. Higher numbers indicate a stronger, more stretchable fabric. The term "load" means the maximum load or force, expressed in units of weight, required to break or rupture the specimen in a tensile test. The term "strain" or "total energy" means the total energy under a load versus elongation curve as expressed in weight-length units. The term "elongation" means the increase in length of a specimen during a tensile test. Values for strip tensile strength and elongation are obtained using a specified width of fabric, usually 1 inch (25 mm), clamp width and a constant rate of extension. The specimen is clamped in, for example, an Instron Model TM, available from the Instron Corporation, 2500 Washington St., Canton, Mass. 02021. This closely simulates fabric stress conditions in actual use.

Example 1

Wet Wipe Formation (See FIG. 1)

A. Wet-laid process

The basic pulp composition of 50% by weight northern softwood unrefined virgin wood fiber pulp (Longlac 19, available from the Kimberly-Clark Corporation), 30% by weight secondary fiber pulp (BJ de-inked secondary fiber pulp available from the Ponderosa Pulp Products, a division of Ponderosa Fibers of America, Atlanta, Ga.); 20% southern softwood kraft, with 0.33% Aerosurf PA-227 debonder available from Aerosurf-Witco, Dublin, Ohio, was wet-laid utilizing conventional papermaking techniques onto a multiply mesh fabric wire. The support wire was PRO 47, having a forming consistency of 0.187%. The pulper was 45#, each batch ran one roll of material. The line speed was 50 feet per minute, with the basis weight being 65 gsm and the width being 22 inches. The web was dewatered down to about 500% water content by dry weight of web.

B. Hydropoint process

The support wire used was the same wire as in step A above. The dewatered web was hydraulically needled with jets of water at about 115 psig from a single manifold equipped with a jet strip having a configuration of 30 holes per inch and a 0.007 inch hole diameter. The discharge port of the jet orifices was between about 9 mm to about 12 mm above the wet-laid web. The web traveled at a rate of about 50 feet per minute. The vacuum manifold pressure drop was 125 inches of water.

The treated web was dried on the support wire to about 5–10% water utilizing a rotary through-air dryer manufactured by Honeycomb Systems, Inc., of Biddeford, Me., using a dryer temperature of 370° F.

C. Print Binder-Side 1

A binder solution was formulated having: 52.6 weight % of an unsaturated carboxylic acid/unsaturated carboxylic acid ester terpolymer (available from LION Corporation, Tokyo, Japan under the tradename LION SSB-3b); 42.8 weight % of Code L9158 (available from AtoFindley, Wauwatosa, Wis.) as a divalent ion inhibiting agent; and 4.6 weight % of a non-crystallizing grade of Sorbitol (available from Pfizer) as a plasticizer was prepared to yield a dispersion containing about 26 weight % solids. The viscosity was 60 cps, roll pressure was 10 psi and binder add-on was a total for both sides of 8% by dry weight. The speed was 100 feet per minute. The print pattern was a large basket weave with a small diamond.

Binder was printed on one side the web according to a conventional process using a bath containing the binder, and a takeup roll having a doctor blade to remove excess binder. The takeup roll contacted a pattern roll such that binder was transferred only to the patterned portion of the pattern roll. The pattern roll and an anvil roll formed the niproll assembly through which was passed the dried web. Dry thickness was 25–26 mil, wet thickness was 19–20 mil, with good wetability.

D. Creping

The web of step C was conveyed to a heated creping cylinder and creped using standard creping techniques whereby the partially dried web was creped from the drying cylinder by a doctor blade.

E. Print Binder-Side 2

The creped web of step D had binder printed on the obverse side by the method described in step C.

F. Re-creping

The printed web of step E was recreped by the method described in step D.

G. Final Processing

The re-creped web of step F was then dried completely, formed into final wet wipe product and stored in Natural Care™ Solution, available from Kimberly-Clark Corporation. The storage solution contained 100 ppm calcium ion concentration.

Figures 3, 4:
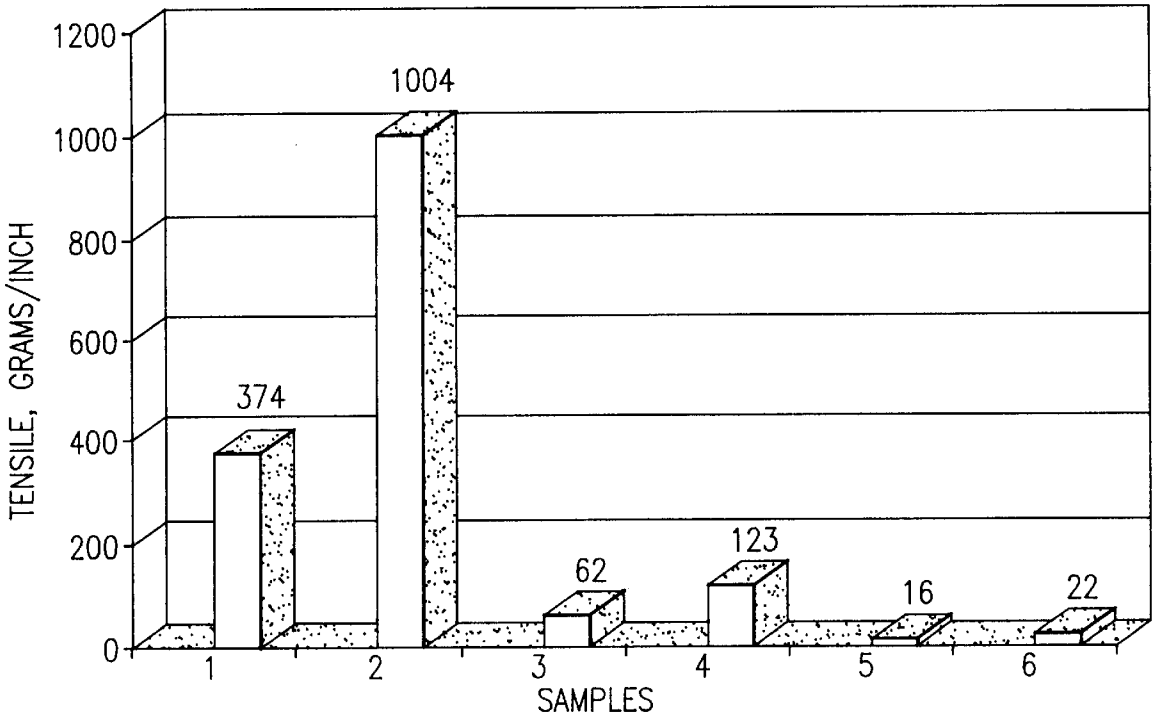
FIG. 3 is a table showing samples tested for tensile strength.
FIG. 4 is a table summarizing the sample compositions and processes of formation.

The results of machine direction tensile testing of the final web are shown in the table of FIG. 3. The table shows the samples on the x-axis and tensile strength measured in grams/inch by the test method described above, on the y-axis. Sample size was approximately 1–6 inches. Sample descriptions as follows are summarized in FIG. 4 in table format:

Sample 1 was a control of a wet-laid web with hydropoint and dewatering only, without binder addition, measured as dry tensile.

Sample 2 was formed by wet-laying the web, hydropointing/partial drying, printing the binder composition, double re-creping, but without addition of the divalent ion, measured as dry tensile.

Sample 3 was formed the same way as Sample 1, but was not creped, and was stored in Natural Care™ Solution with 100 ppm calcium ions, measured as wet tensile.

Sample 4 was Sample 2, after adding the binder and storing in the Natural Care™ Solution with 100 ppm calcium ions, measured as wet tensile.

Sample 5 shows Sample 3 after being placed in tap water for five minutes, measured as wet tensile.

Sample 6 shows Sample 4 after being placed in tap water for five minutes, measured as wet tensile.

As FIG. 3 indicates, Sample 4, containing the binder, displays substantially higher tensile (123 g/in) than Sample 3, which did not contain the binder. When Samples 5 and 6 were immersed in tap water for five minutes, they lost strength rapidly to about 16–25 g/in, indicating that the materials will readily disperse in water. Materials showing a strength of less than about 50 g/in are considered dispersible by those of ordinary skill in the art.

Example 2

Dry Wipe Formation (See FIG. 2)

The web is formed according to the process of Example 1, steps A–C. After the binder composition is added to the first side, a solution of calcium ions is sprayed on the same side to give a calcium ion add on of about 100 ppm based on the basis weight of the web. The web is creped and binder added to the second side, as described in Example 1, steps E and F. A solution of calcium ions is sprayed on the second side to give a calcium ion add on of about 100 ppm based on the basis weight of the web. The web is then re-creped and dried as described in Example 1, steps F and G. For final processing, the web is dried completely and formed into dry wipe product.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means plus function claims are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

It should further be noted that any patents, applications or publications referred to herein are incorporated by reference in their entirety.

What is claimed is:

1. A soft, absorbent nonwoven fibrous web capable of dispersing in an aqueous environment into unrecognizable pieces, formed by a method comprising the steps of:

a) forming a nonwoven web having a first and a second side from fibers, b) hydraulically needling and dewatering said nonwoven web of step a);

c) at least partially drying said hydraulically needled web;

d) applying a binder composition to at least one side of said web, wherein said binder composition comprises i) from about 25 weight % to about 90 weight % of an unsaturated carboxylic acid/unsaturated carboxylic acid ester terpolymer;

ii) from about 10 weight % to about 75 weight % of a divalent ion inhibitor; and iii) from about 0 weight % to about 10 weight % of a plasticizer, iv) wherein said binder composition is soluble in an aqueous environment having a divalent ion concentration less than about 50 ppm and a monovalent ion concentration of less than about 0.5 weight %;

e) creping said web at least twice from a creping surface such that interfiber adhesion is disrupted;

f) drying said web; and, g) applying an effective amount of a solution containing an ion to said web.

2. The web of claim 1, wherein the web in step a) is formed by a wet-laid process.

3. The web of claim 1, wherein the web in step a) is formed by an air-laid process.

4. The web of claim 1, wherein said fibers comprise pulp.

5. The web of claim 4, wherein said pulp is selected from the group consisting of deciduous trees, coniferous trees, cotton, flax, esparto grass, milkweed, straw, jute, and bagasse.

6. The web of claim 4, wherein said fibers further comprise synthetic fibers.

7. The web of claim 6, wherein said synthetic fibers are selected from the group consisting of rayon, lyocell, polyester, and polypropylene.

8. The web of claim 6, wherein said synthetic fibers are present in a blend of up to about 30% by weight.

9. The web of claim 1, wherein said binder composition comprises an acrylic acid-based terpolymer, a divalent ion inhibitor and a plasticizer.

10. The web of claim 1, wherein said ion is a multivalent ion.

11. The web of claim 1, wherein said ion is a divalent ion.

12. The web of claim 11, wherein said divalent ion is added to the final web product as part of a storage solution.

13. The web of claim 12, wherein said divalent ion is selected from the group consisting of calcium and magnesium.

14. The web of claim 13, wherein said calcium ion is present in a concentration sufficient to impart wet tensile in excess of about 50 gm/inch.

15. The web of claim 13, wherein said calcium ion is present in a concentration sufficient to impart wet tensile in excess of about 100 gm/inch.

16. The web of claim 13, wherein said calcium ion is present in a concentration of from about 25 ppm to about 300 ppm.

17. The web of claim 13, wherein said calcium ion is present in a concentration of from about 50 ppm to about 200 ppm.

18. The web of claim 13, wherein said calcium ion is present in a concentration of about 100 ppm.

19. The web of claim 1, further comprising the step of applying a binder composition to said second side of said web after said first creping procedure.

20. A soft, absorbent wet wipe formed by the method of claim 1 stored in a preserving solution containing calcium ion in a concentration of from about 25 ppm to about 300 ppm based on the basis weight of the web.

21. A soft, absorbent nonwoven fibrous web capable of dispersing in an aqueous environment into unrecognizable pieces, formed by a method comprising the steps of:

a) forming a nonwoven web having a first and second side from fibers;

b) hydraulically needling and dewatering said nonwoven web of step a);

c) at least partially drying said hydraulically needled web;

d) applying a binder composition to said first side of said web;

e) applying an effective amount of a solution containing an ion to said first side of said web;

f) creping said web from a creping surface such that interfiber adhesion is disrupted;

g) applying a binder composition to said second side of said web:

h) applying an effective amount of a solution containing an ion to said second side of said web;

I) re-creping said web from a creping surface such that interfiber adhesion is disrupted;

j) drying said web;

wherein at least one of said binder composition of step d) or step g) comprises:

I) from about 25 weight % to about 90 weight % of an unsaturated carboxylic acid/unsaturated carboxylic acid ester terpolymer;

ii) from about 10 weight % to about 75 weight % of a divalent ion inhibitor; and iii) from about 0 weight % to about 10 weight % of a plasticizer;

iv) wherein said binder composition is soluble in an aqueous environment having a divalent ion concentration less than about 50 ppm and a monovalent ion concentration of less than about 0.5 weight %.

22. The web of claim 21, wherein the web in step a) is formed by a wet-laid process.

23. The web of claim 21, wherein the web in step a) is formed by an air-laid process.

24. The web of claim 21, wherein said fibers comprise pulp.

25. The web of claim 24, wherein said pulp is selected from the group consisting of deciduous trees, coniferous trees, cotton, flax, esparto grass, milkweed, straw, jute, and bagasse.

26. The web of claim 24, wherein said fibers further comprise synthetic fibers.

27. The web of claim 26, wherein said synthetic fibers are selected from the group consisting of rayon, lyocell, polyester, and polypropylene.

28. The web of claim 26, wherein said synthetic fibers are present in a blend of up to about 30% by weight.

29. The web of claim 21, wherein said fibers further include a superabsorbent material.

30. The web of claim 21, wherein both of said binder composition comprises an acrylic acid-based terpolymer, a divalent ion inhibitor and a plasticizer.

31. The web of claim 30, wherein both of said binder compositions comprises a) from about 25 weight % to about 90 weight % of an unsaturated carboxylic acid/unsaturated carboxylic acid ester terpolymer;

b) from about 10 weight % to about 75 weight % of a divalent ion inhibitor; and, c) from about 0 weight % to about 10 weight % of a plasticizer, wherein said binder composition is soluble in an aqueous environment having a divalent ion concentration less than about 50 ppm and a monovalent ion concentration of less than about 0.5 weight %.

32. The web of claim 21, wherein said ion is a multivalent ion.

33. The web of claim 21, wherein said ion is a divalent ion.

34. The web of claim 33, wherein said divalent ion is sprayed onto said web.

35. The web of claim 33, wherein said divalent ion is selected from the group consisting of calcium and magnesium.

36. The web of claim 34, wherein said calcium ion is present in a concentration sufficient to impart wet tensile in excess of about 50 gm/inch.

37. The web of claim 34, wherein said calcium ion is present in a concentration sufficient to impart wet tensile in excess of about 100 gm/inch.

38. The web of claim 34, wherein said calcium ion is present in a concentration of from about 25 ppm to about 300 ppm based on the basis weight of the web.

39. The web of claim 34, wherein said calcium ion is present in a concentration of from about 50 ppm to about 200 ppm based on the basis weight of the web.

40. The web of claim 34, wherein said calcium ion is present in a concentration of about 100 ppm based on the basis weight of the web.

41. A soft, absorbent wet wipe having a basis weight of from about 50 gsm to about 100 gsm, tensile strength in excess of 50 g/inch and being dispersible within 10 minutes of being placed in an aqueous environment, comprising:

a) a nonwoven fibrous material containing pulp and synthetic fiber, said synthetic fiber being in a concentration of less than 30%;

b) a binder composition of from about 5 weight % to about 25 weight % add on, said binder composition comprising from about 25 weight % to about 90 weight % of an unsaturated carboxylic acid/unsaturated carboxylic acid ester terpolymer, from about 10 weight % to about 75 weight % of a divalent ion inhibitor, and from about 0 weight % to about 10 weight % of a plasticizer, wherein said binder composition is soluble in an aqueous environment having a divalent ion concentration less than about 50 ppm and a monovalent ion concentration of less than about 0.5 weight %; and, c) calcium ion in a concentration of from about 50 ppm to about 200 ppm.

42. A fibrous web having two substantially planar surfaces formed of a slurry of wood pulp fibers and synthetic fibers, at least one of said surfaces having a binding material applied in a pattern thereto, and said web having been subjected to hydraulic needling and said web having been creped at least twice from a creping surface, and at least one of said surfaces having a solution containing a divalent ion applied thereto.

43. A soft, absorbent nonwoven fibrous web capable of dispersing in an aqueous environment into unrecognizable pieces, formed by a method comprising the steps of:

a) forming a nonwoven web having a first and a second side from fibers;

b) hydraulically needling and dewatering said nonwoven web of step a);

c) at least partially drying said hydraulically needled web;

d) applying a binder composition to at least one side of said web, wherein said binder composition comprises i) from about 25 weight % to about 90 weight % of an unsaturated carboxylic acid/unsaturated carboxylic acid ester terpolymer;

ii) from about 10 weight % to about 75 weight % of a divalent ion inhibitor; and iii) from about 0 weight % to about 10 weight % of a plasticizer, iv) wherein said binder composition is soluble in an aqueous environment having a divalent ion concentration less than about 50 ppm and a monovalent ion concentration of less than about 0.5 weight %;

e) creping said web at least twice from a creping surface such that interfiber adhesion is disrupted;

f) drying said web; and, g) applying an effective amount of a solution containing a multivalent ion to said web.

* * * * *